US010259622B2

(12) United States Patent
Hill

(10) Patent No.: US 10,259,622 B2
(45) Date of Patent: Apr. 16, 2019

(54) LIQUID DISPENSING SPOUT

(71) Applicant: Joseph M. Hill, Hawthorne, CA (US)

(72) Inventor: Joseph M. Hill, Hawthorne, CA (US)

( * ) Notice: Subject to any disclaimer, the term of this patent is extended or adjusted under 35 U.S.C. 154(b) by 0 days.

(21) Appl. No.: 15/428,047

(22) Filed: Feb. 8, 2017

(65) Prior Publication Data

US 2018/0222643 A1 Aug. 9, 2018

Related U.S. Application Data

(63) Continuation-in-part of application No. 14/684,337, filed on Apr. 11, 2015, now abandoned.

(51) Int. Cl.

| | |
|---|---|
| ***B65D 47/12*** | (2006.01) |
| ***B65D 25/48*** | (2006.01) |
| ***B65D 41/04*** | (2006.01) |

(52) U.S. Cl.

CPC ..... *B65D 47/122* (2013.01); *B65D 25/48* (2013.01); *B65D 41/0442* (2013.01)

(58) Field of Classification Search

CPC ..... B65D 25/40; B65D 25/48

USPC ..... 222/547, 564, 566–569, 468, 475; 215/274, 276, 349, 362, 363

See application file for complete search history.

(56) References Cited

U.S. PATENT DOCUMENTS

| | | | | | |
|---|---|---|---|---|---|
| 2,070,783 | A * | 2/1937 | Conner | B65D 47/061 | 222/539 |
| 2,736,469 | A * | 2/1956 | Stone | B65D 47/061 | 222/529 |
| 3,410,459 | A * | 11/1968 | Conley | B65D 1/04 | 215/385 |
| D216,248 | S * | 12/1969 | Hills | D9/529 | |
| 4,412,633 | A * | 11/1983 | Guerrazzi | B65D 1/20 | 215/398 |
| 4,765,514 | A * | 8/1988 | Berglund | B65D 1/04 | 215/385 |
| 6,098,850 | A * | 8/2000 | Ho | A01G 27/02 | 222/185.1 |
| 6,523,720 | B1 * | 2/2003 | Robbins, III | B29C 49/0073 | 222/1 |
| 9,254,944 | B1 * | 2/2016 | Peckels | B65D 25/48 | |
| 2011/0068134 | A1 | 3/2011 | Yang | | |

* cited by examiner

*Primary Examiner* — Lien M Ngo
(74) *Attorney, Agent, or Firm* — John Alumit

(57) ABSTRACT

A liquid dispensing spout having a housing, a detachably attached cylindrical hollow gasket, a flat circular hollow gasket and a lid with a flat circular lid gasket at the inner top surface. The housing includes a top open end with an outer threaded end, a bottom open end with an inner threaded end adapted to mount to at least one container, an outer portion and an inner portion. The inner portion has an open channel extending between the top open end and the bottom open end. A triangular shaped non-moving in-line splitter is positioned in the open channel to provide a dual passage of the liquid and air thereby controlling the flow of the liquid and air flowing back from the container such that the liquid gently flows out at a greatly reduced velocity.

6 Claims, 7 Drawing Sheets

LIQUID DISPENSING SPOUT

CROSS-REFERENCE TO RELATED APPLICATION

This application is a continuation-in-part of U.S. patent application Ser. No. 14/684,337 filed Nov. 4, 2015 for Liquid Dispensing Spout, which is currently pending.

FEDERALLY SPONSORED RESEARCH

Not Applicable

SEQUENCE LISTING OR PROGRAM

Not Applicable

BACKGROUND

Technical Field of the Disclosure

The present disclosure relates in general to fluid dispensers. More specifically, the present disclosure relates to an improved liquid dispensing spout with a triangular in-line splitter attached to a container containing liquid allowing the dual passage of the liquid and air in a controlled and uniform manner at a greatly reduced velocity without surge, splash or spill and eliminating the need for any moving parts.

Description of the Related Art

Liquid dispensers are used to transfer the liquid stored in one container to another containers. The liquid dispensers are attached to the bottles containing liquids and allow the liquid to be dispensed in a uniform manner. Traditional liquid dispensers use either a manifold system that acts as a one-way valve, or multiple tubes working in conjunction with one-way valves to allow air and the liquid to flow out of a spout and dispense the liquid.

One of the existing liquid dispensers discloses an improved pouring spout of the type of one's which are connected to a filling container for transferring liquid in a receiving container. These kind of pouring spouts include an inlet tube for receiving liquid from the filling container, and an outlet tube telescopically mounted to slide onto the inlet tube for guiding liquid therefrom into the receiving container. The spout also comprises a liquid valve which opens and closes automatically upon sliding of the outlet tube. The spout further comprises an air passage and an air valve for regulating an air flow inside the spout from the receiving container into the receiving container, such that the flow of liquid inside the spout stops automatically when the receiving container is full, thereby avoiding spillage of liquid. However, the improved pouring spout uses multiple tubes to dispense the liquid and a valve system to control the flow of liquid. Moreover, the spout involves certain complications in order to prevent leakage of liquid through the air vents, especially when the spout is first opened.

Another existing spill inhibiting spout discloses a spout for mounting on a liquid container to provide controlled dispensing of liquid therefrom includes a manual control for stopping the flow of liquid through a pouring tube and an automatic control to prevent spills due to overfilling. Manual control over the amount of liquid flowing through the pouring opening of the spout is provided by a preferably tubular rod having a stop mounted at one end and a push button actuator at the other end of the rod. The spout includes a body with the pouring tube extending from one side and the push button for opening the stop to dispense liquid on the other side of the body. The automatic control is provided through a vent tube which extends through a port in the pouring tube and is connected to the tubular rod which is provided with at least one hole. When the level of liquid in a receiving tank rises over the port, no air enters the liquid container and consequently the flow of liquid from the pouring tube is discontinued. However, the system does not have any arrangements to eliminate splashing or excess liquid being discharged from the bottle containing liquid.

Another existing non-spilling detachable pouring spout is configured to transfer liquid from a non-vented filling container to a receiving container. This spout having a spout body defining an open passageway extending from an open first end to an open second end this open passageway having a generally tubular shaped hollow inner conduit positioned within the first hollow passageway, and defining a second hollow passageway. An intermediate sleeve is configured for attachment to the device and is further configured to seal against portions of the spout body and the inner conduit so as to variously control the flow of materials out of the spout body. The movement of said sleeve is controlled by movement of a child resistant sheath. However, the system does not provide any method to prevent the vaporization of fluid when not in use.

Another existing no-spill cup construction and valve assembly provides an extremely secure seal against accidental liquid flow from the cup spout. The act of sucking at the cup spout creates negative pressure or a partial vacuum against a valve near the spout, causing the valve to invert which unblocks an opening in the valve. When the opening is unblocked, liquid can flow freely through the valve and spout. When not in use, the valve sits in a resting, closed position, with the valve pressed against a center seal-off, sealing off the opening in the valve assembly. The closed position provides an extremely secure seal against fluid leakage, such that inadvertent spills or even deliberate attempts to force liquid outside of the cup, such as by turning the cup upside down, or shaking the cup, are ineffective. The cup assembly further allows liquid flow to be regulated between regular or maximum flow and minimal flow levels or rates by rotating the position of the valve assembly in the cover of the cup. However, the system does not provide any means to regulate the air flow for preventing spillage of liquid.

Yet another method provides a combination of a one-piece full flow cap valve and improved neck finish of a fluid bottle. The one-piece full flow cap valve is made of a single injection molded piece, capable of discharging fluid at full flow capacity. This combination of one-piece cap valve and the neck valve requires a sealing means and a captive means to enable the fluid bottle to operate in a closed position and in an open position respectively. These extra components increase the manufacturing cost. Further, the flow area of outlet spout is defined by a complex construction and does not provide any means to regulate the air flow for preventing spillage of liquid. Moreover, this combination is not configured to fit on different sized fluid bottles, and the length of the combination of the cap valve and the neck finish lacks enough length to dispense the liquid into hard-to-reach areas with the requisite ease and control.

Therefore, there is a need for an improved liquid dispensing spout that would allow the liquid to be dispensed with a controlled and uniform manner. Such a needed liquid dispensing spout would possess simple construction and eliminate the need to incorporate the one-way valves and multiple tubes to dispense the liquid. Such a needed device would include a triangular shaped non-moving in-line splitter at the base of the spout pointing towards the opening of the top of the spout that would be configured to provide dual tubes used for the passage of liquid and air, eliminating the need for any moving parts thereby minimizing surging and splashing or excess liquid being rapidly discharged from the container. Such a needed device would be configured to fit on different sized fluid bottles and would possess enough length to dispense liquid into hard-to-reach areas with greater ease and control. Such a needed device would allow air to flow along the top passage equalizing the liquid flowing out for preventing surging and spillage of liquid. Such a liquid dispensing spout would also include a lid to close the container when not in use to prevent the vaporization of the liquid from the container. Finally, the liquid dispensing spout would be inexpensive and once installed in the container, the liquid dispensing spout can be reused multiple times. The present embodiment overcomes prior art shortcomings by accomplishing these critical objectives.

SUMMARY OF THE INVENTION

The present embodiment is an improved liquid dispensing spout that is attached to at least one container containing liquid allowing the liquid to be dispensed with a controlled and uniform manner. The liquid dispensing spout is configured to constrict the volume of liquid and force the liquid along the bottom passage by a triangle in-line splitter and allowing air to pass through the front of the liquid dispensing spout along the top passage into the liquid container equalizing the liquid flowing out and eliminate surging and splashing or excess liquid being discharged from the at least one container containing the liquid. The liquid dispensing spout comprises a housing having a top open end with an outer threaded end, a bottom open end with an inner threaded coupler, an outer portion and an inner portion. The bottom open end is adapted to mount to the attached container using an inside threaded coupler. The inner portion includes a triangle where the base of the triangle acts as restrictor, an open channel extending between the top open end and the bottom open end. A cylindrical hollow coupler is detachably attached to the bottom open end of the housing. The cylindrical hollow coupler firmly tightens the bottom open end of the housing with at least one container. A flat circular hollow gasket is detachably positioned at the contact point between the cylindrical hollow coupler and the bottom open end of the housing, adapted to seal at the contact point between the cylindrical hollow gasket and the bottom open end of the housing. The triangle non-moving in-line splitter diverter is positioned in the open channel adjacent to the inner threaded end, facing with the base at the mouth of the spout and the apex pointing towards the top opening of the spout. The non-moving in-line splitter is triangular in shape in which the legs of the triangle provide a dual passage of liquid and air thereby equalizing the flow of liquid and air flowing back from the attached container such that the liquid gently flows out at a greatly reduced velocity. A lid with a flat circular lid gasket at the inner top surface is attached on the top open end along the outer threaded end of the liquid dispensing spout. The lid prevents the escape of vapor and liquid inside the attached container when not in use.

The non-moving in-line triangular splitter restricts the liquid flowing out of the attached container. The air enters the front of the spout and is able to pass along top tube formed by the triangle shape of the non-moving valve and allows the attached container to breathe and pass the liquid along the bottom passage open end of the liquid dispensing spout. The triangular shape of the non-moving in-line splitter eliminates the need of moving parts while dispensing the liquid. The spout functions due to the triangle shaped in-line splitter. The base of the triangle is configured in the spout so that when it is attached to the liquid container, the base of the triangle restricts the volume of liquid that is able to flow out of the liquid container through the bottom tube defined by the triangle, while allowing air to enter the opening of the spout and flow along the top inside tube equalizing the amount of liquid flowing out.

The non-moving in-line splitter provides the dual passage of both liquid being poured out and air flowing back into the attached container to facilitate the equilibrium required to have a smooth and controlled pouring of the liquid from the liquid dispensing spout. The triangular design of the non-moving in-line splitter restricts the amount of liquid able to flow out of the liquid container and allows the diversion of the liquid to the bottom open passage and the transmission of air along the top open passage, keeping equilibrium during the entire process of pouring the liquid out of the attached container.

The liquid flowing out of the container is restricted by the base of the non-moving in-line triangular splitter and the liquid flows into the bottom open tube. The volume of liquid does not fill the entire space of the open tube near the top of the liquid dispensing spout and occupies about ⅓ of the area. The law of gravity keeps the liquid flowing along the bottom portion of the liquid dispensing spout while air is being drawn up along the top side of the inside of the liquid dispensing spout along the open upper tube into the at least one container by a naturally occurring vacuum effect as the liquid is being displaced. The displaced volume of liquid is replaced by the air to maintain the equilibrium.

The triangular non-moving in-line splitter allows the air to ventilate from the top open end passage in the liquid dispensing spout to an opening of the attached container and liquid being transferred along the liquid dispensing spout is restricted such that the liquid gently flows out at a greatly reduced velocity. The liquid dispensing spout equalizes the air flow and liquid being dispensed to prevent surging and spillage of liquid while pouring. The liquid dispensing spout is configured to fit on various sized bottles and the length of the liquid dispensing spout allows the dispensing of the liquid into hard to reach areas with greater ease and control. The cylindrical hollow coupler enables the liquid dispensing spout to detachably attach to the container by tightening the bottom open end of the housing using the inside threaded coupler with the container. The flat circular hollow gasket seals the contact point between the open bottom end and the container so that liquid will not leak at those contact points. The unique design of the non-moving in-line triangular splitter eliminates the need to incorporate the one-way valves and multiple tubes to dispense the liquid.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness. Referring now to the drawings that form a part of the original disclosure.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
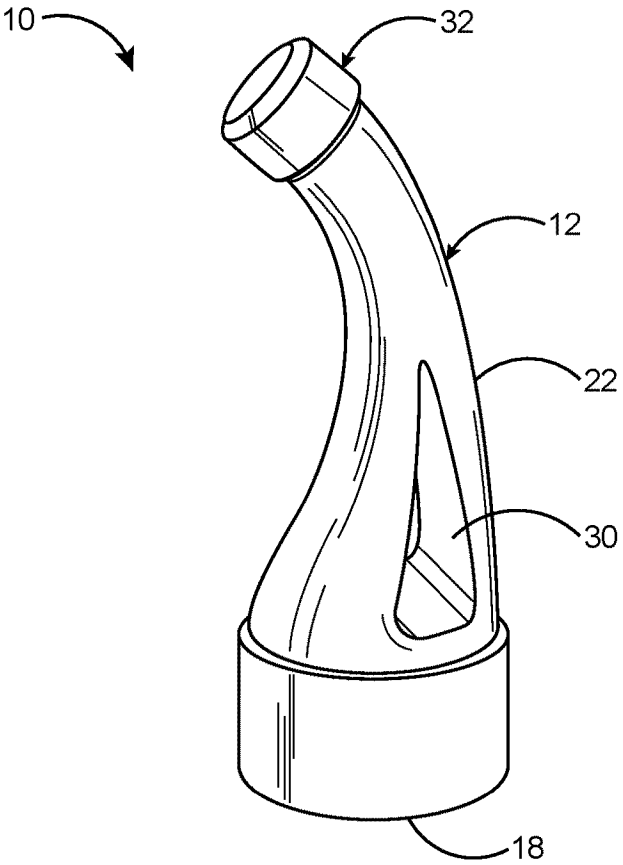
FIG. 1 illustrates a perspective view of a liquid dispensing spout in accordance with a preferred embodiment of the present invention.

Turning first to FIG. 1, a perspective view of a liquid dispensing spout 10 in accordance with a preferred embodiment of the present invention is illustrated. The liquid dispensing spout 10 comprises a housing 12 having a top open end 14 (see FIG. 2) with an outer threaded end 16 (see FIG. 2), a bottom open end 18 with an inner threaded end 20 (see FIG. 3), an outer portion 22 and an inner portion 24 (see FIG. 3). The top open end 14 is closed utilizing a lid 32. The bottom open end 18 is adapted to mount to at least one container 126 (see FIG. 7). The inner portion 24 includes an open channel 28 (see FIG. 3) extending between the top open end 14 and the bottom open end 18. The housing 12 further comprises a non-moving triangular in-line splitter 30 positioned in the open channel 28 proximate the inner threaded end 20 and configured to provide dual passage of the liquid and air. The liquid dispensing spout 10 allows the flow of liquid and air flowing back from the at least one container 26 such that the liquid gently flows out at a greatly reduced velocity.

Figure 2:
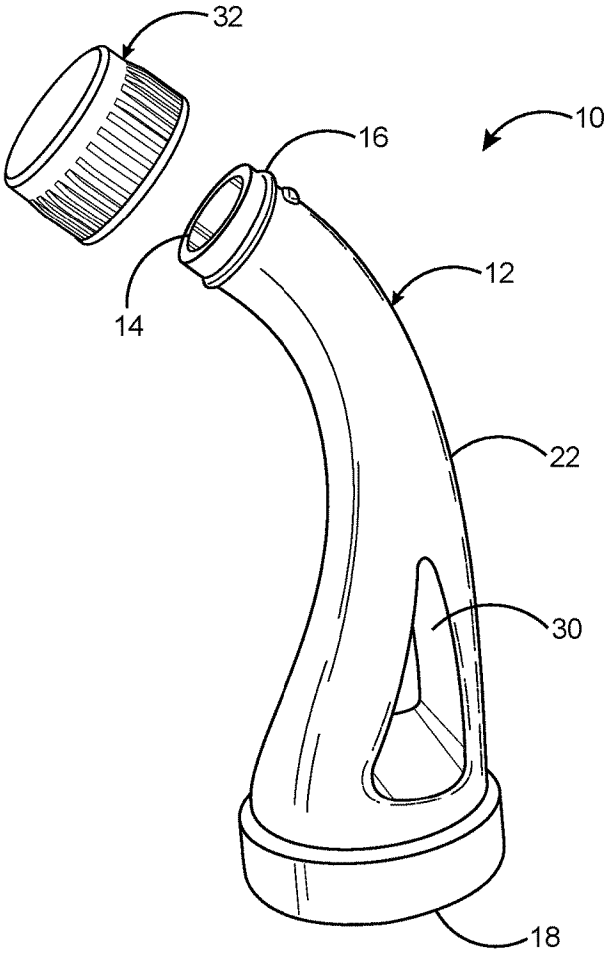
FIG. 2 illustrates a perspective view of the liquid dispensing spout wherein a lid is detached from the liquid dispensing spout of the preferred embodiment of the present invention.

FIG. 2 is a perspective view of the liquid dispensing spout 10 wherein the lid 32 is detached from the liquid dispensing spout 10 in accordance with the preferred embodiment of the present invention. The lid 32 is attached on the top open end 14 of the housing along the outer threaded end 16. The lid 32 prevents the escape of vapor and liquid inside the at least one container 26 when not in use.

Figure 3:
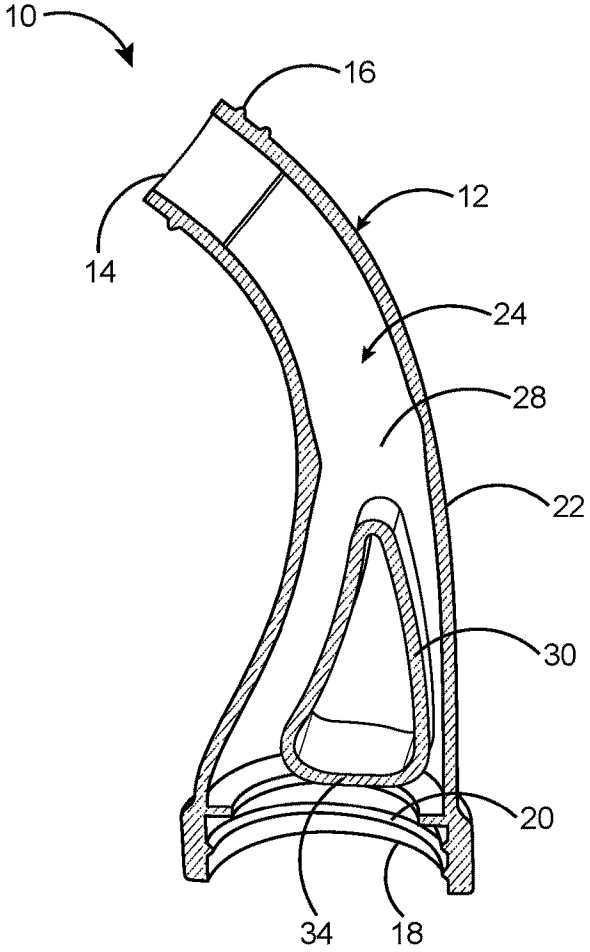
FIG. 3 illustrates a cross-sectional view of the liquid dispensing spout in accordance with the preferred embodiment of the present invention.
Figure 4:
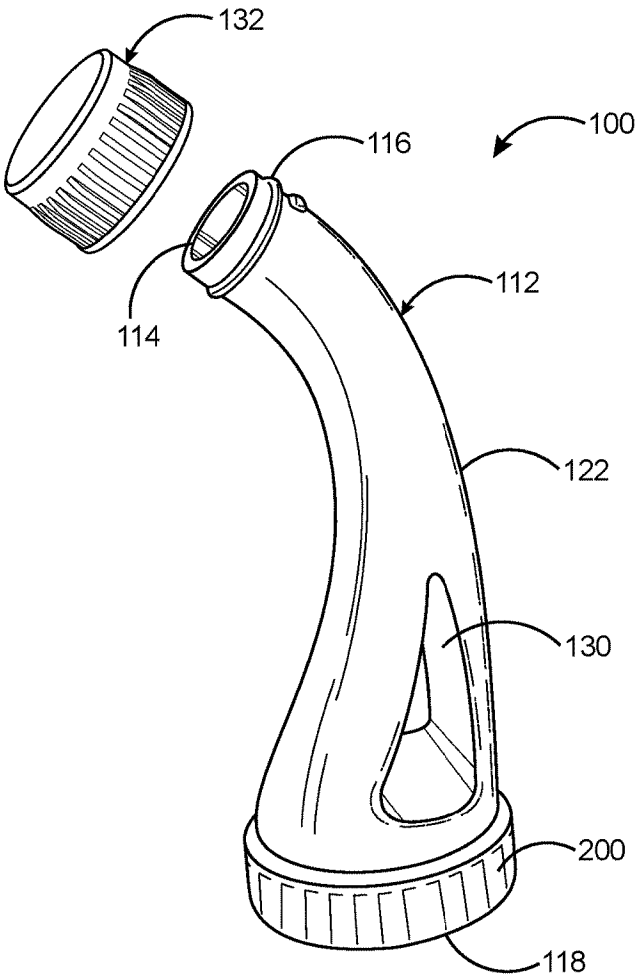
FIG. 4 is a perspective view of a second embodiment of a liquid dispensing spout and the addition of a hollow cylindrical coupler at the bottom open end of the housing and a flat hollow circular gasket at the contact point between the cylindrical hollow coupler and the bottom open end of the housing.

FIG. 3 illustrates a cross-sectional view of the liquid dispensing spout 10 threaded end 20, with a flat base 34 proximate to the bottom open end (18) of the housing, against the flow of liquid, and the apex of the triangle pointing to the top opening of the spout 28 proximate to the inner threaded end 20. The non-moving triangular in-line splitter 30 is triangular in shape thereby creating a passage below for the liquid to flow and a passage above for the air to equalize the container and modulating the flow of liquid and air from the at least one container 26. The triangle shape of the non-moving triangular in-line splitter may be equilateral, isosceles, or scalene. The non-moving triangular in-line splitter 30 provides the dual passage of the liquid and air to modulate the liquid flowing out of the at least one container 26. The flat base 34 of the non-moving triangular in-line splitter 30 reduces the volume of liquid that is able to pass out of the at least one container 26. The air is able to pass along top of the non-moving triangular in-line splitter 30 and allows the at least one container 26 to breath and pass the liquid along the bottom passage open end of the liquid dispensing spout 10. The triangular shape of the non-moving triangular in-line splitter 30 eliminates the need of moving parts while dispensing the liquid. The liquid dispensing spout 10 is configured to constrict the volume of liquid and force the liquid along the bottom passage by a triangle in-line splitter 30 and allowing air to pass through the front of the liquid dispensing spout 10 along the top passage into the liquid container equalizing the liquid flowing out and eliminate surging and splashing or excess liquid being discharged from the at least one container 26 containing the liquid.

The non-moving triangular in-line splitter 30 facilitates the equilibrium required to have a smooth and controlled pouring of the liquid from the liquid dispensing spout 10 that is mathematically formulated for optimum efficiency. The triangular design of the non-moving in-line splitter 30 allows the base 34 of the triangle to reduce the volume of liquid able to flow out and facilitates the diversion of the liquid to the bottom open end 18 and the passage of air along the top open end 14, keeping equilibrium during the entire process of pouring the liquid out of the at least one container 26. The liquid dispensing spout 10 allows the air to pass through the liquid dispensing spout 10 so that the liquid is modulated and does not surge, splash or spill during the process of pouring the liquid. The liquid dispensing spout 10 allows the air to pass along the top open end 14 in relation to the liquid flowing out along the bottom open end 18, so that it will always be a steady stream flowing out of the liquid dispensing spout 10. The base 34 of the triangle 30 is configured in the spout 10 so that when it is attached to the liquid container 26, the base 34 of the triangle 30 restricts the volume of liquid that is able to flow out of the liquid container 26 through the bottom tube defined by the triangle 30, while allowing air to enter the opening of the spout 10 and flow along the top inside tube equalizing the amount of liquid flowing out.

When the air circulates from the top open end 14 in the liquid dispensing spout 10 to an opening of the at least one container 26, the liquid is transferred along the bottom passage of the liquid dispensing spout and 10 is restricted by the base 34 of the triangular non-moving in-line splitter such that the liquid gently flows out at a greatly reduced velocity.

As shown in FIG. 3, the liquid flowing out of the container 26 is restricted by the base 34 of the non-moving in-line triangular splitter 30 which causes the liquid to flow towards the bottom open tube. The volume of liquid does not fill the entire space of the open tube near the top of the liquid dispensing spout 10 and occupies about ⅓ of the area. The law of gravity keeps the liquid flowing along the bottom portion of the liquid dispensing spout 10 while air is being drawn up along the top side of the inside of the liquid dispensing spout 10 along the open upper tube into the at least one container 26 by a naturally occurring vacuum effect as the liquid is being displaced. The displaced volume of liquid is replaced by the air to maintain the equilibrium.

A second embodiment of the present invention is shown in FIGS. 4-7 as liquid dispensing spout 100. This second embodiment is substantially the same as the first embodiment of FIGS. 1-3 and like reference numerals are used in FIGS. 4-7 with the addition of 100 thereto to refer to similar elements as in the first embodiment. In particular, the liquid dispensing spout 100 comprises a housing 112 having a top open end 114 with an outer threaded end 116, a bottom open end 118 with an inner threaded end 120, an outer portion 122 and an inner portion 124. The bottom open end 118 is adapted to mount to at least one container 126 (see FIG. 7). The inner portion 124 (see FIG. 5) includes an open channel 128 (see FIG. 5) extending between the top open end 114 and the bottom open end 118. The housing 112 further comprises a non-moving triangular in-line splitter 130 positioned in the open channel with the apex of the triangle facing the open top of the spout 124 proximate the inner threaded end 120 and configured to provide dual passage of the liquid and air. The liquid dispensing spout 100 modulates the flow of liquid out of the spout and air flowing back from the at least one container 126 such that the liquid gently flows out at a greatly reduced velocity and does not surge, splash or spill.

Figure 5:
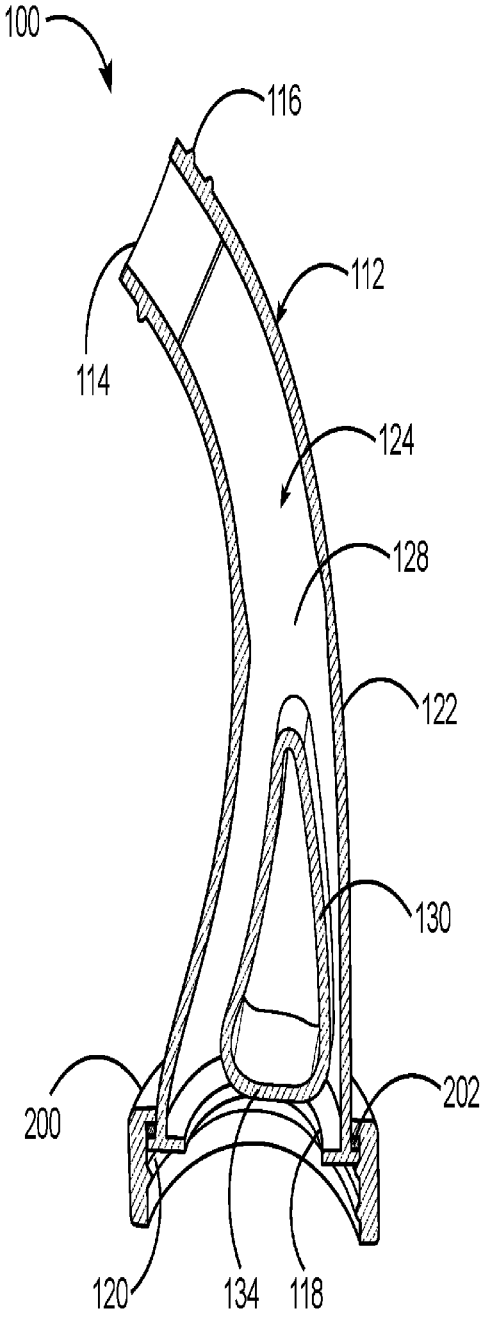
FIG. 5 is cross-sectional view of the liquid dispensing spout in accordance with the second embodiment of the present invention.
Figure 6:
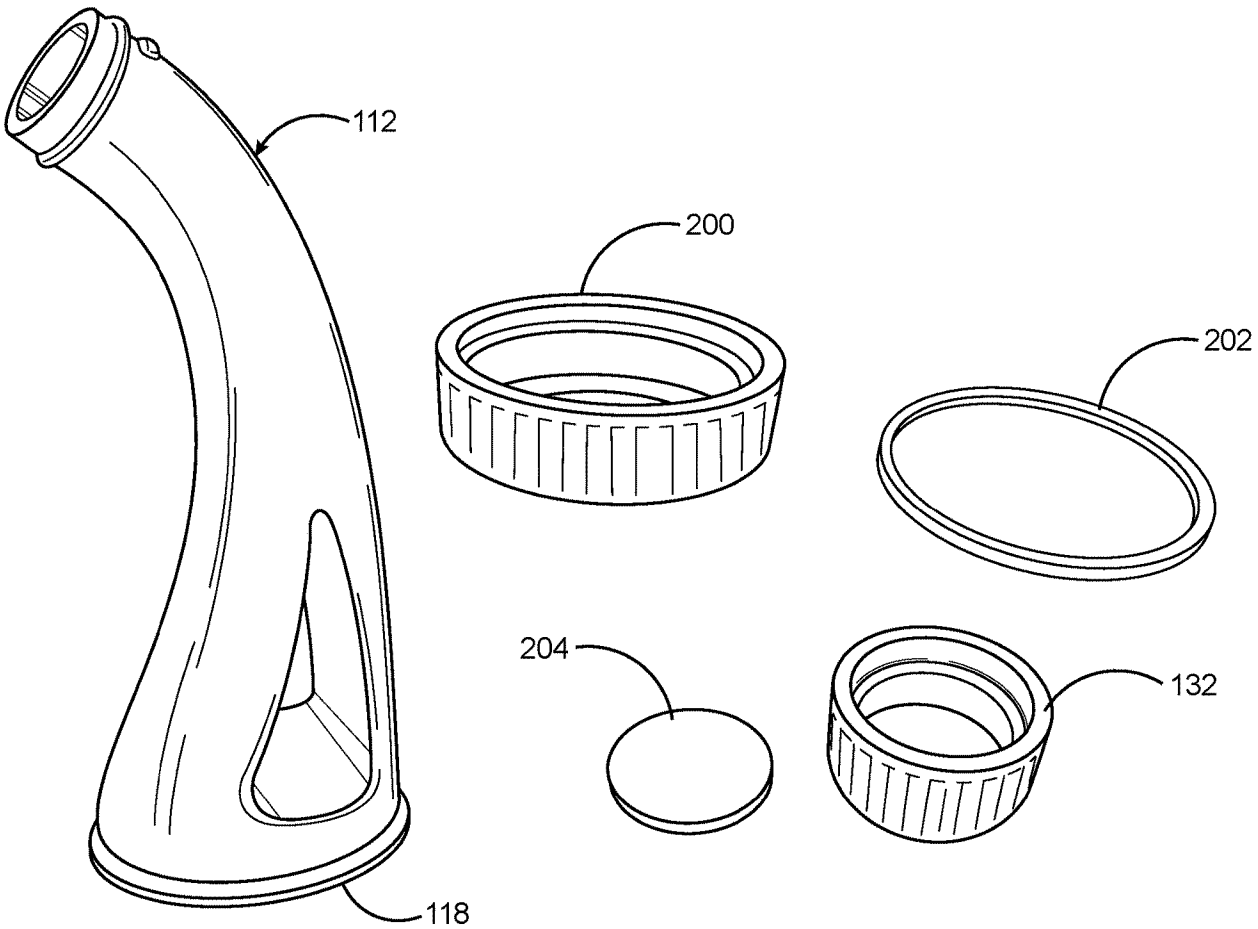
FIG. 6 shows each structural part of the liquid dispensing spout in accordance with the second embodiment of the present invention.
Figure 7:
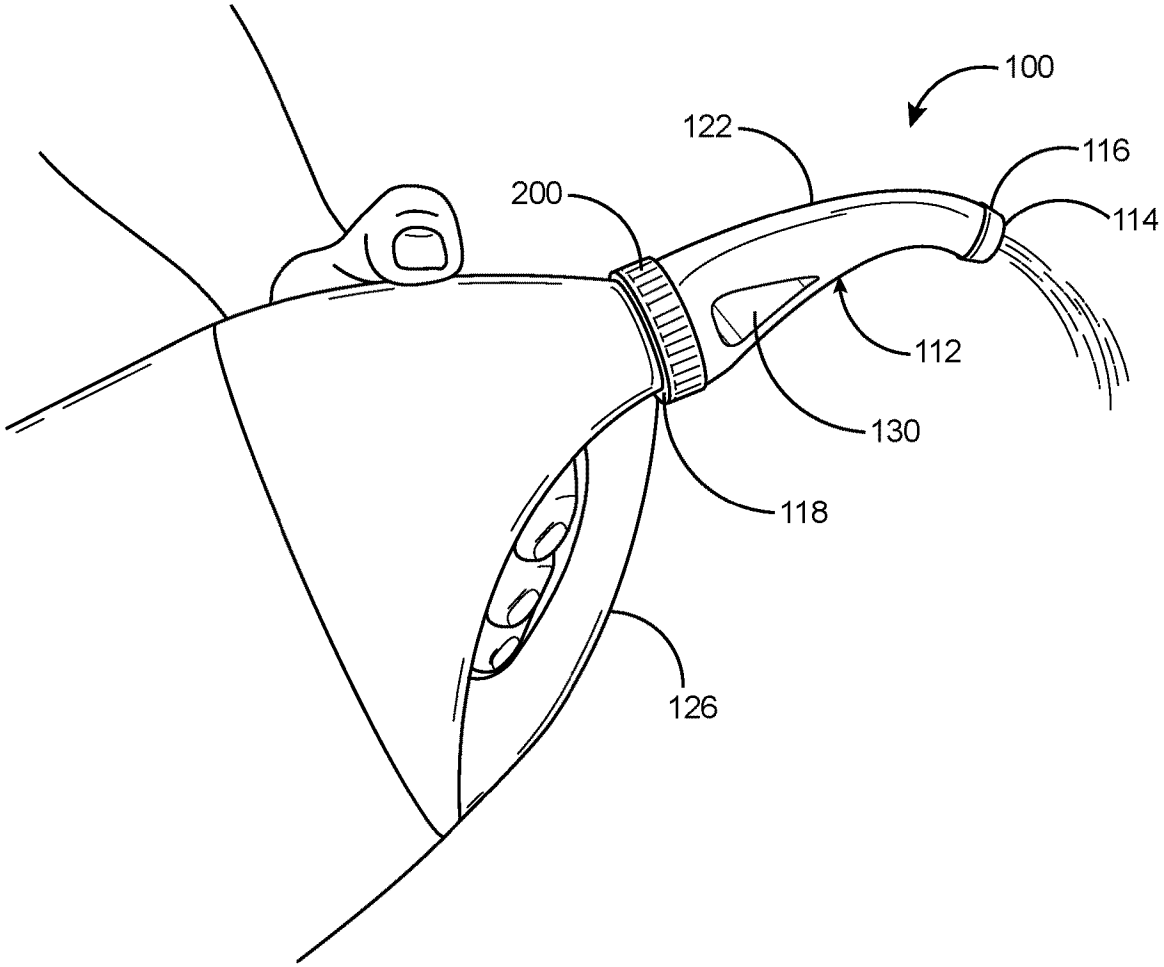
FIG. 7 illustrates a perspective view of the liquid dispensing spout when in use.

As shown in FIGS. 5-7, the second embodiment is modified by the addition of a cylindrical hollow coupler with inside threads 200 detachably attached to the bottom open end 118 of the housing 112 to firmly tighten the housing 112 with the at least one container 126 and a flat circular hollow gasket 202 detachably positioned at the contact point between the cylindrical hollow coupler 200 and the bottom open end 118 of the housing 112 adapted to seal at the contact point between the cylindrical hollow coupler 200 and the bottom open end 118 of the housing 112, adapted to seal at the contact point between the cylindrical hollow coupler 200 and the bottom open end 118 of the housing 112. The second embodiment also includes a circular lid gasket 204 detachably attached to the inner top surface of the lid 132. The base 134 of the non-moving triangular in-line splitter 130 restricts the liquid flowing out of the container 126 which causes the liquid to flow towards the bottom open tube thereby modulating the flow of the liquid and air flowing back from the at least one container 126 such that the liquid gently flows out at a greatly reduced velocity.

The liquid dispensing spout 10 is configured to fit on various sized bottles and the length of the spout 10 provides the dispensing of the liquid into hard to reach areas with greater ease and control. The unique triangular design of the non-moving triangular in-line splitter 30 eliminates the need to incorporate the one-way valves and multiple tubes to dispense the liquid.

The liquid dispensing spout 10 is easily applicable for home use, business and commercial applications. The liquid dispensing spout 10 is inexpensive and once installed in the at least one container, the liquid dispensing spout 10 can be reused multiple times.

The foregoing description of the preferred embodiment of the present invention has been presented for the purpose of illustration and description. It is not intended to be exhaustive or to limit the invention to the precise form disclosed. Many modifications and variations are possible in light of the above teachings. For example, the shape of the non-moving triangular in-line splitter 30 can be modified. It is intended that the scope of the present invention not be limited by this detailed description, but by the claims and the equivalents to the claims appended hereto.

What is claimed is:

1. A liquid dispensing spout attachable to at least one container comprising:

a housing having a top open end (114) with threading on an outer surface (116) of the top open end, and a bottom open end (118), the bottom open end being adapted to mount to at least one container; an open channel (128) extends between the top open end and the bottom open end within the housing;

a non-moving triangular in-line splitter (130) positioned in the open channel proximate to the bottom open end of the housing, with a flat base (134) proximate to the bottom open end of the housing and the apex of the triangular in-line splitter pointing to the top open end of the housing;

a cylindrical hollow coupler with inside threads (200) detachably attached to the bottom open end of the housing to firmly tighten the housing with the at least one container;

a flat circular hollow gasket (202) detachably positioned at the contact point between the cylindrical hollow coupler (200) and the bottom open end of the housing;

a lid (132) detachably attached on the top open end of the housing along the threading on the outer surface (116) of the top open end; and a circular lid gasket (204) detachably attached to an inner top surface of the lid;

whereby the triangular design of the non-moving in-line splitter allows the base of the triangle to reduce the volume of liquid able to flow out and facilitates the diversion of the liquid to the bottom open end at a greatly reduced velocity and the passage of air along the top open end thereby allowing dual passage of liquid and air.

2. The liquid dispensing spout of claim 1, wherein the circular hollow gasket is configured to firmly tighten the bottom open end of the housing to the at least one container.

3. The liquid dispensing spout of claim 1, wherein the circular flat hollow gasket is adapted to seal at the contact point between the cylindrical hollow coupler and the bottom open end of the housing.

4. The liquid dispensing spout of claim 1, wherein the lid is configured to prevent escape of vapor and liquid inside the at least one container when not in use.

5. A liquid dispensing spout attachable to at least one container comprising:

a housing having a top open end with threading on an outer surface of the top open end (14), a bottom open end (18) with an inner threaded surface (20), the bottom open end (18) being adapted to mount to at least one container, an open channel (28) extends between the top open end and the bottom open end within the housing;

a non-moving triangular in-line splitter (30) positioned in the open channel (28) proximate to the inner threaded surface of the bottom open end, with a flat base (34) proximate to the bottom open end of the housing and the apex of the triangle pointing to the top opening of the housing;

a cylindrical hollow coupler detachably attached to the bottom open end of the housing to firmly tighten the bottom open end of the housing with the at least one container;

a lid attached on the top open end along the outer threaded end, the lid being configured to prevent the escape of vapor and liquid inside the at least one container when not in use; and a flat circular lid gasket detachably attached to the inner top surface of the lid;

whereby the triangular design of the non-moving in-line splitter allows the base of the triangle to reduce the volume of liquid able to flow out and facilitates the diversion of the liquid to the bottom open end at a greatly reduced velocity and the passage of air along the top open end thereby allowing dual passage of liquid and air.

6. The liquid dispensing spout of claim 5, wherein the triangular in-line has an equilateral, isosceles, or scalene shape.

* * * * *